United States Patent [19]

LaFleur et al.

[11] Patent Number: 4,781,472

[45] Date of Patent: Nov. 1, 1988

[54] LARGE BAG WITH LINER

[75] Inventors: Arnie LaFleur; Lee LaFleur, both of Manistee, Mich.

[73] Assignee: Custom Packaging Systems, Inc., Manistee, Mich.

[21] Appl. No.: 118,304

[22] Filed: Nov. 6, 1987

[51] Int. Cl.[4] ..... B65D 33/06

[52] U.S. Cl. ..... 383/16; 383/105; 383/17; 220/403

[58] Field of Search ..... 383/16, 17, 20, 21, 383/22, 28, 6, 105; 220/403, 404, 470

[56] References Cited

U.S. PATENT DOCUMENTS

| | | | |
|---|---|---|---|
| 3,384,106 | 5/1968 | Isbrandtsen | 220/403 |
| 3,951,284 | 4/1976 | Fell et al. | 220/404 |
| 3,965,953 | 6/1976 | Becker et al. | 383/906 |
| 4,362,199 | 12/1982 | Futerman | 383/17 |
| 4,457,456 | 7/1984 | Derby et al. | 383/17 |
| 4,461,402 | 7/1984 | Fell et al. | 220/403 |
| 4,597,102 | 6/1986 | Nattrass | 383/105 |
| 4,674,127 | 6/1987 | Yamaha et al. | 383/22 |

*Primary Examiner*—Willis Little

*Attorney, Agent, or Firm*—Barnes, Kisselle, Raisch, Choate, Whittemore & Hulbert

[57] ABSTRACT

A large bulk bag with a complimentary liner therein, both of a flexible material, and constructed and arranged so that when empty they can be folded into a generally flat and compact configuration. At least two spaced apart connectors between the bag and liner prevent the liner from being drawn out of the bag by the discharge of its contents while permitting the liner to collapse upon itself without being substantially restrained from doing so by the bag.

26 Claims, 2 Drawing Sheets

FIG. 1
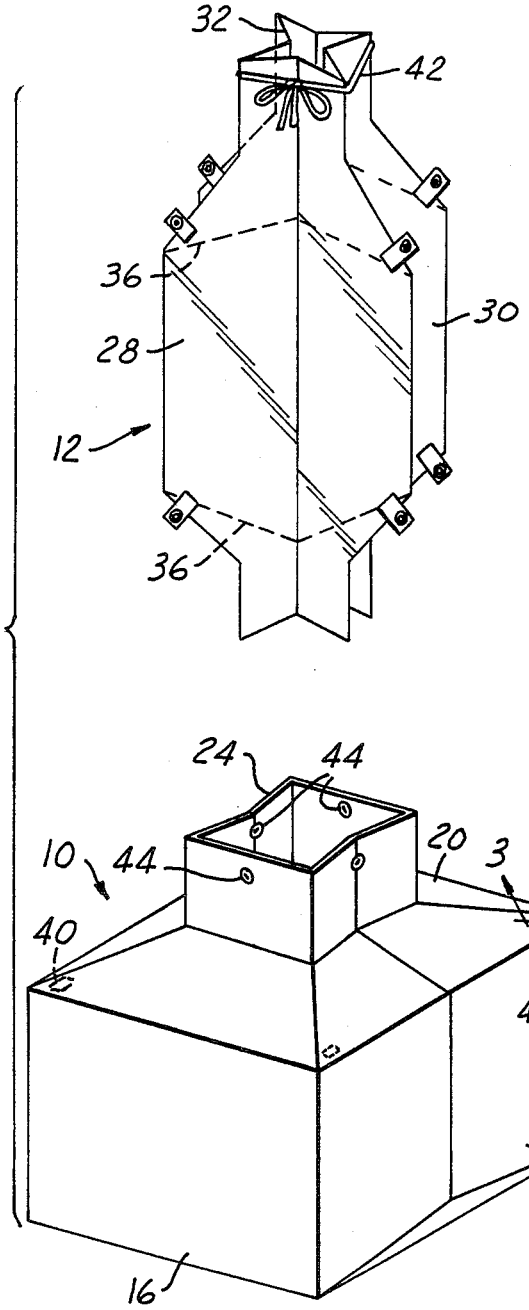
FIG. 2
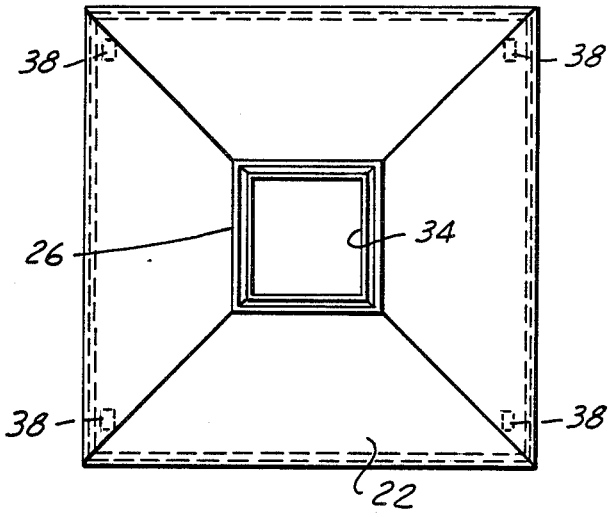
FIG. 3
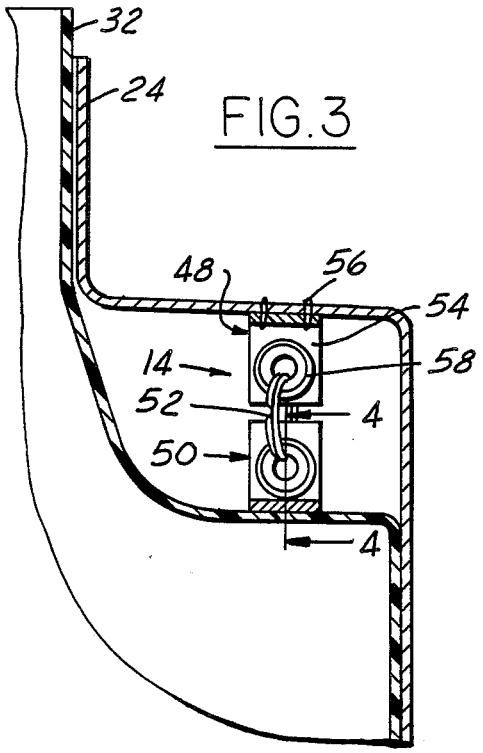
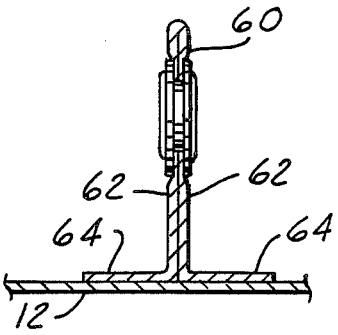
FIG. 4

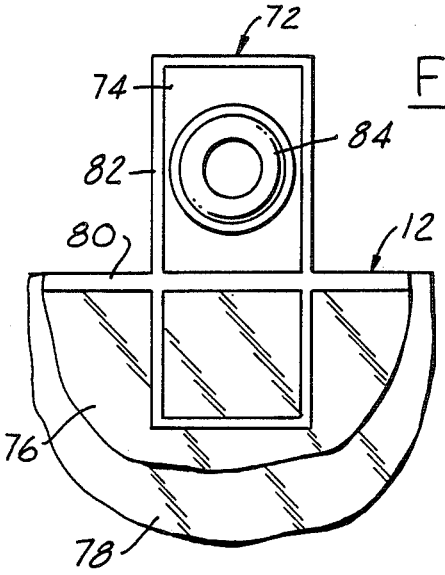
FIG.5
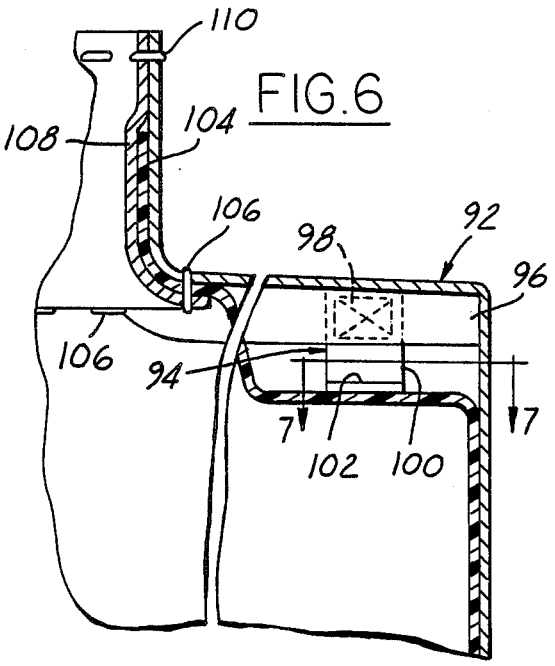
FIG.6
FIG.7
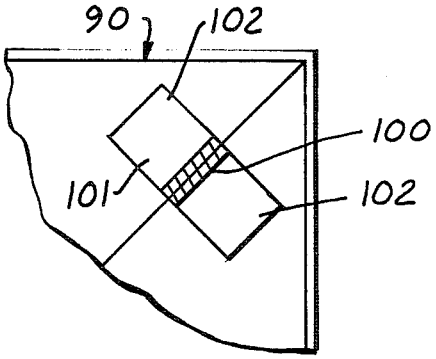

LARGE BAG WITH LINER

This invention relates to a shipping and storage container and, more specifically, to a large bulk, collapsible container in the form of a bag made of a woven fabric, and particularly to such a bag having a liner.

BACKGROUND

Many products, such as granular and liquid materials, are shipped and stored in large bulk bags adapted to hold as much as a ton or more of material. The use of bags for this purpose has become popular recently because the bags can be shipped from the manufacturer to the material shipper in a generally collapsed and flat condition and, if properly designed, when empty can be returned by the user to the shipper in the same generally collapsed and flat condition for reuse.

A bag used in the above manner has to fulfill several practical requirements. It is of primary importance that the construction of the bag be such as to sustain relatively heavy loads. At the same time, it is essential that the bag be adapted to be folded or collapsed when empty to a compact and preferably flat form. Frequently, because of the nature and quantity of material shipped in such bags, the bags should also be designed so that they can be easily filled and emptied of their contents. It is also desired that such bags be designed so that, when filled, they are free standing and capable of being stacked vertically one upon another. Furthermore, depending upon the type of material being shipped, some bags are also required to be moisture-proof, water resistant, impervious and/or hygenic in which case a liner is provided having a similar configuration to the bags. A particularly satisfactory bag and loose liner which can be inserted into and removed from the bag is disclosed in U.S. Pat. No. 4,596,040.

Another flexible bag with a liner permanently secured therein by stitching along the side edges of the bag is disclosed in U.S. Pat. No. 4,597,102.

When a liner is used in connection with such large bags to contain particulate or granular material and the bag is formed with an opening or a spout at one or both ends for discharging the contents, a common problem is the tendency for the material when discharged to draw the liner out of the bag. Frequently, this discharge produces sufficient force to tear a liner stitched to the bag along its side edges so that it must collapse with the bag.

Objects, features and advantages of this invention are to provide a large bag with a liner which obviates the aforementioned problems; wherein the liner may be either readily and easily removable and replaceable or permanently attached to the bag, and is of economical manufacture and assembly.

SUMMARY

In accordance with this invention, a large bag is provided with a liner which has the general configuration of the bag, and is connected to the bag at selected locations so that when its contents are being discharged the liner can collapse on itself independently of and without being substantially restrained from collapsing by the bag. In one form, the connection is detachable so that the liner can be replaced and in another form, the connection is permanent. To facilitate filling and reuse of the liner, preferably it is connected to the bag adjacent both ends of the liner.

BRIEF DESCRIPTION OF THE DRAWINGS

These and other objects, features and advantages of this invention will be apparent from of the following detailed description, appended claims, and accompanying drawings in which:

FIG. 1 is a fragmentary exploded view of a bag and a liner embodying this invention;

FIG. 2 is a bottom view of the bag and liner;

FIG. 3 is a sectional view on an enlarged scale taken along the line 3—3 in FIG. 1;

FIG. 4 is a sectional view taken along the line 4—4 in FIG. 3;

FIG. 5 is a fragmentary side view of a modified liner;

FIG. 6 is a fragmentary sectional view of a modified bag and liner embodying this invention; and FIG. 7 is a fragmentary sectional view taken along the line 7—7 in FIG. 6.

DETAILED DESCRIPTION

Referring in more detail to the drawings, FIGS. 1-4 illustrate this invention in a large bulk bag 10 with a complimentary liner 12 receivable in the bag and attachable to it by connectors 14. Preferably, the bag is made of a flexible woven fiber material and the liner is made of a film or sheet of a flexible impervious material. Preferably, both the bag and liner are made of a polypropylene or polyethylene plastic material.

Preferably, the bag and liner when filled are generally cubical and when empty can be collapsed and folded into a generally flat and compact configuration with the liner in the bag. Preferably, the bag has a pair of generally flat side panels 16 connected by a pair of gusseted foldable side panels 18 and integral ends 20 and 22. Preferably, the bag has a first spout 24 in the top for filling the bag and a second spout 26 in the bottom for discharging the contents of the bag. However, if desired, the bag can have only one spout with the other end being fully closed. For some applications, the bag may have no spout, but rather one end which is normally open, a side wall and a bottom which is fully closed and connected to the side wall. The normally open end is closed by simply gathering together and tying off a portion of the side wall adjacent such end. The preferred construction and arrangement of the generally cubical and collapsible bag 10 with a spout in one or both ends is fully disclosed in U.S. Pat. No. 4,596,040, the disclosure of which is incorporated herein by reference.

The construction and arrangement of the liner 12 is preferably essentially complimentary to that of the bag in which it is received. The liner has a pair of side panels 28, a pair of gusseted panels 30 and spouts 32 and 34. When fully expanded, the panels of the bag also fold in the area of the broken lines 36 in FIG. 1 to provide a generally cubical configuration with opposed end walls. Liner 12 is of sufficient size so that when the bag is filled the liner is forced into firm engagement with and supported by the sides and bottom of the bag without stretching, tearing or damagng the liner. The construction and arrangement of the preferred liner is also fully disclosed in U.S. Pat. No. 4,596,040.

In accordance with this invention, the liner is connected to the bag adjacent the end with the outlet or discharge spout and preferably adjacent both ends of the liner. Since, while being emptied, the bag does not always readily collapse, the liner is connected to the bag so that it can collapse onto itself independently of the bag. To insure that the liner can collapse onto itself independently of the bag, preferably it is not connected to the bag at all four corners on both ends.

Preferably, as shown in FIG. 2, the bottom of the liner is connected to the bag in at least two, and preferably four, spaced apart locations 38 each adjacent the bottom and the side of the bag. Preferably, adjacent its other end, the liner is also connected to the bag in at least one location and preferably two, diagonally opposed locations 40. However, if desired, either in lieu of or in addition to the connections at the locations 40, the central portion of the upper end of the liner can be connected to the bag. This can be accomplished by tying off the liner spout 32 such as with a cord 42 and then tying the cord to the spout 24 of the bag through one of its grommets 44.

If the bags will be reused many times it may be desirable or necessary to remove and replace the liner. To facilitate doing so, the liner is removably connected to the bag. As shown in FIG. 4, the liner can be removably connected at the locations 38 and 40 by the connectors 14. Each connector 14 has a pair of tabs 48 and 50 releasably connected together by a key ring fastener 52. Preferably, the tab 48 is a strip 54 of woven fabric secured adjacent one end to the bag, such as by stitches 56, and having a grommet 58 therein adjacent its free end. As shown in FIG. 4, preferably tab 50 is a loop 60 of flexible material with overlapped runs 62 and end portions 64 secured to the end of the liner, such as by an adhesive. Preferably, the loop 60 is an adhesive tape, which if desired can be a fiber reinforced filament tape, such as Scotch brand 898 filament tape, sold by the Packaging Systems Div. of 3M Company of St. Paul, Minn.

FIG. 5 illustrates a liner 12 with a modified tab 72 which is preferably a homogenously integral part of the liner. The tab 72 has two pieces 74 of overlapped plastic liner material, such as polypropylene or polyethylene, each of which is preferably a homogenously integral portion of adjacent panels 76 and 78 forming part of an end of the liner. The adjacent panels are connected together by a heat seal or seam 80. The overlapped tab pieces 74 are connected together along their periphery by a heat seal or seam 82 which also extends into and interconnects adjacent portions of the liner panels 76 and 78 to reinforce the tab. A grommet 84 is secured in the tab adjacent its free end.

FIGS. 6 and 7 illustrate a modified liner 90 permanently connected in a bag 92 which is otherwise the same as bag 10. The liner 90 and bag 92 are connected together by tabs 94 at substantially the same locations 38 and 40 as the liner 12 is connected to the bag 10. At each of these locations a tab 94 is permanently connected to an end of the liner and permanently secured to a flange portion 96 of an end of the bag 92 by stitches 98. Typically, the flanges are marginal portions of woven fabric of adjacent panels stitched together to form the ends of the bag. Preferably, each tab 94 is a loop of fiber reinforced adhesive tape with overlapped runs adhered together and end portions 102 adhered to an end portion of the liner. If a large number of liners 90 are made, it may be economically desirable to make the tabs 94 of two pieces of plastic film heat sealed together and integral with panel portions forming an end of the liner in a manner similar to that of making the tab 72.

For applications where the liner 90 and bag 92 will be reused many times, it is preferable, but not necessary, to connect to the bag the end portion of the liner adjacent the discharge or outlet spout 104 such as by stitches 106 securing them together outboard of an extending around the periphery of the spout. This connection causes the forces produced on the spout by the material being discharged to be transmitted to the bag thereby reducing the tendency of such forces to pull the liner through the spout. With bags having spouts in both ends, since either spout could be used to discharge its contents, it is desirable to stitch both ends of the liner to the bag by stitches 106 each adjacent and around the periphery of its associated spout. In bags with liners having spouts in both ends stitched with stitches 106 encircling the spouts in each end, usually the tab connectors 94 can be eliminated and the liner can still collapse onto itself independently of the bag and without being drawn out of the bag by the discharge of its contents.

To further reduce wear on the spouts of bags which will be reused repeatedly, it is also desirable to insert a wear sleeve 108 of flexible woven fabric material in overlapping relationship with the liner spout and secure them both to the bag such as by stitching 106 and 110.

We claim:

1. In combination with a flexible and collapsible bulk bag having a side wall, ends and an opening adjacent one end to the exterior of the bag through which contents are discharged, and a flexible and collapsible liner received in said bag generally complimentary thereto and having a side wall, ends and an opening adjacent one end through which the contents are discharged; the improvement comprising, at least two connectors between said liner and bag and each connecting said liner to said bag, said connectors being spaced apart and each located adjacent a side wall portion of said bag and adjacent the one end of said bag and liner having the discharge openings therethrough, and all of said connectors being constructed, arranged, located and connected to said liner such that said liner is not withdrawn from said bag and can collapse upon itself during discharge of the contents thereof independently of and without being substantially restricted by said bag from collapsing, whereby the contents of said bag and liner are discharged through said openings without the liner being withdrawn from said bag by such discharge.

2. The combination bag and liner of claim 1 wherein said connectors permanently connect said liner to said bag.

3. The combination bag and liner of claim 1 wherein each of said connectors comprises means constructed and arranged to be disconnectable so that the liner can be detached and removed from the bag.

4. In combination with a flexible and collapsible bulk bag having a sidewall, ends and an opening adjacent one end to the exterior of the bag through which contents are discharged, and a flexible and collapsible liner received in said bag generally complimentary thereto and having a sidewall, ends and an opening adjacent one end through which the contents are discharged; the improvement comprising, at least two connectors between said liner and bag and each connecting said liner to said bag, said connectors being spaced apart and each located adjacent a sidewall portion of said bag and adjacent the one end of said bag and liner having the discharge openings therethrough, each of said connectors having a first tab connected to said bag and having a hole therethrough, a second tab connected to said liner and having a hole therethrough, and a fastener received in both of said holes of said first and second tabs and constructed and arranged to releasably connect the tabs together so that the liner can be disconnected and removed from the bag, and all of said connectors being constructed, arrangned, located and connected to said liner such that said liner is not withdrawn from said bag and can collapse upon itself during discharge of the contents thereof independently of and without being substantially restricted by said bag from collapsing, whereby the contents of said bag and liner are dislcharged through said openings without the liner being withdrawn from said bag by such discharge.

5. The combination of bag and liner of claim 4 wherein said fastener comprises a removable ring.

6. The combination bag and liner of claim 4 which also comprises a grommet disposed in said hole of each of said first and second tabs.

7. The combination bag and liner of claim 4 wherein each of said second tabs is a loop of adhesive tape with its end portions adhered to said liner.

8. The combination bag and liner of claim 4 wherein each of said second tabs is a loop of fiber reinforced adhesive tape with its end portions adhered to said liner.

9. The combination bag and liner of claim 4 wherein said liner is made of plastic film and each of said second tabs comprises two strips of overlapped plastic film heat sealed together and each a homogenously integral portion of a panel of plastic film of said liner.

10. In combination with a flexible and collapsible bulk bag having a sidewall, ends and an opening adjacent one end to the exterior of the bag through which contents are discharged, and a flexible and collapsible liner received in said bag generally complimentary thereto and having a sidewall, ends and an opening adjacent one end through which the contents are discharged; the improvement comprising, at least two connectors between said liner and bag and each connecting said liner to said bag, said connectors being spaced apart and each located adjacent a sidewall portion of said bag and adjacent the one end of said bag and liner having the discharge openings therethrough, each of said connectors is a loop of fiber reinforced adhesive tape with its end portions adhered to said liner, and all of said connectors being constructed, arranged, located and connected to said liner such that said liner is not withdrawn from said bag and can collapse upon itself during discharge of the contents thereof independently of and without being substantially restricted by said bag from collapsing, whereby the contents of said bag and liner are discharged through said openings without the liner being withdrawn from said bag by such discharge.

11. The combination bag and liner of claim 10 wherein each loop of adhesive tape has overlapped runs adhered together and end portions each adhered to a portion of said liner.

12. The combination bag and liner of claim 11 wherein a portion of said loop of tape of each of said connectors is secured to said bag by stitches.

13. The combination bag and liner of claim 1 wherein said liner is made of plastic film and each of said connectors comprises two strips of overlapped plastic film heat sealed together and each a homogeneously integral portion of a panel of plastic film of said liner, and said strips are permanently secured to said bag.

14. The combination bag and liner of claim 1 which also comprises at least one connector located adjacent the other end of said bag and liner and connecting said liner to said bag.

15. The combination bag and liner of claim 14 wherein at least four of said connectors are located adjacent said one end of said bag and liner.

16. The combination bag and liner of claim 1 which also comprises at least two spaced apart connectors located adjacent the other end of said bag and liner, and each also located adjacent the side of said bag and liner and connecting said liner to said bag.

17. The combination bag and liner of claim 1 wherein at least four of said connectors are located adjacent said one end of said bag and liner.

18. The combination bag and liner of claim 1 which also comprises a discharge spout of said bag at least in part defining said discharge opening of said bag, a discharge spout of said liner defining at least in part said discharge opening of said liner and being extendable into said discharge spout of said bag.

19. In combination with a flexible and collapsible bulk bag having a sidewall, ends and an opening adjacent one end to the exterior of the bag through which contents are discharged, and a flexible and collapsible liner received in said bag generally complimentary thereto and having a sidewall, ends and an opening adjacent one end through which the contents are discharged; the improvement comprising, at least two connectors between said liner and bag and each connecting said liner to said bag, said connectors being spaced apart and each located adjacent a sidewall portion of said bag and adjacent the one end of said bag and liner having the discharge openings threthrough, a discharge spout of said bag at least in part defining said discharge opening of said bag, a discharge spout of said liner defining at least in part said discharge opening of said liner and being extendable into said discharge spout of said bag, a connector located generally upstream of and adjacent to said discharge liner spout and permanently connecting said bag and liner together upstream of said spout of said discharge liner, and all of said connectors being constructed, arranged, located and connected to said liner such that said liner is not withdrawn from said bag and can collapse upon itself during discharge of the contents thereof independently of and without being substantially restricted by said bag from collapsing, whereby the contents of said bag and liner are discharged through said openings without the liner being withdrawn from said bag by such discharge.

20. The combination bag and liner of claim 19 which also comprises a wear sleeve of a flexible material received within and lapping at least a portion of said spouts of both said liner and bag, and a connector permanently connecting said sleeve to said bag upstream of the outlet end of said spout of said bag.

21. The combination bag and liner of claim 20 wherein said last mentioned connector also connects said liner to said bag upstream of, adjacent to and generally around the periphery of said discharge spout of said liner.

22. The combination bag and liner of claim 19 wherein said bag when expanded has a generally cubical configuration with a pair of generally rectangular side wall panels connected by a pair of gusseted side panels and is constructed and arranged such that when the bag is empty it can be collapsed and folded into a generally flat configuration.

23. The combination bag and liner of claim 21 wherein said liner has a pair of generally rectangular side panels and a pair of interconnecting gusseted panels complimentary to their corresponding bag panels and is constructed and arranged when expanded to have a generally cubical configuration and when empty can be folded into a generally flat configuration.

24. In combination with a flexible and collapsible bulk bag having a side wall, ends and a spout adjacent each end which can be opened to the exterior of the bag and through which its contents can be discharged, and a flexible and collapsible liner received in said bag generally complimentary thereto and having a side wall, ends and a spout in each end through which the contents can be discharged; the improvement comprising, at least one connector between said liner and bag adjacent each end and each connecting said liner to said bag, each connector being located adjacent the periphery of an associated spout and its associated end and permanently connecting together said bag and liner, and all of said connectors being constructed, arranged, located and connected to said liner such that said liner is not withdrawn from said bag and can collapse upon itself during discharge of the contents thereof independently of and without being substantially restricted by said bag from collapsing, whereby the contents of said bag and liner are discharged through said openings without the liner being withdrawn from said bag by such discharge.

25. The combination bag and liner of claim 24 wherein each of said connectors extends generally around the periphery of its associated spout.

26. The combination bag and liner of claim 24 wherein each of said connectors comprises stitching extending generally around substantially the entire periphery of its associated spout.

* * * * *

US004781472C1

(12) EX PARTE REEXAMINATION CERTIFICATE (5840th)

United States Patent
LaFleur et al.

(10) Number: US 4,781,472 C1
(45) Certificate Issued: Aug. 7, 2007

(54) LARGE BAG WITH LINER

(75) Inventors: Arnie LaFleur, Manistee, MI (US); Lee LaFleur, Manistee, MI (US)

(73) Assignee: Scholle Custom Packaging, Inc., Manistee, MI (US)

Reexamination Request:
No. 90/007,113, Jul. 13, 2004

Reexamination Certificate for:
Patent No.: 4,781,472
Issued: Nov. 1, 1988
Appl. No.: 07/118,304
Filed: Nov. 6, 1987

(51) Int. Cl.
*B65D 33/06* (2006.01)

(52) U.S. Cl. ..... 383/16; 383/105; 383/17; 383/111

(58) Field of Classification Search ..... 383/6, 383/16, 17, 20–22, 24, 28, 105, 111
See application file for complete search history.

(56) References Cited

U.S. PATENT DOCUMENTS 3,961,655 A * 6/1976 Nattrass et al. ..... 383/24
4,113,146 A * 9/1978 Williamson ..... 222/105
4,143,796 A * 3/1979 Williamson et al. ..... 222/181.3
4,390,051 A * 6/1983 Cuthbertson ..... 383/111
4,596,040 A * 6/1986 LaFleur et al. ..... 383/7
4,658,989 A * 4/1987 Bonerb ..... 222/105
4,691,371 A * 9/1987 Derby ..... 383/62
4,946,291 A * 8/1990 Schnaars ..... 383/113

FOREIGN PATENT DOCUMENTS

JP S63-162486 * 7/1988
JP S63-19108 * 3/1992

* cited by examiner

*Primary Examiner*—Jimmy G. Foster

(57) ABSTRACT

A large bulk bag with a complimentary liner therein, both of a flexible material, and constructed and arranged so that when empty they can be folded into a generally flat and compact configuration. At least two spaced apart connectors between the bag and liner prevent the liner from being drawn out of the bag by the discharge of its contents while permitting the liner to collapse upon itself without being substantially restrained from doing so by the bag.

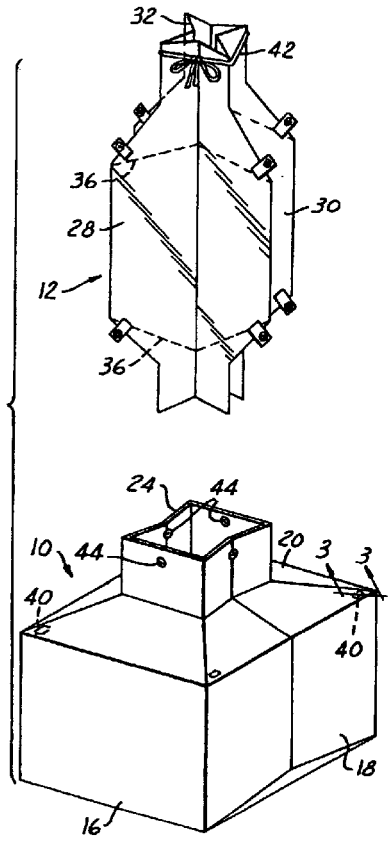

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 10–12 is confirmed.

Claims 1, 3, 4, 20, 21, 24 and 25 are cancelled.

Claims 2, 5–9, 13, 14, 16–19, 23 and 26 are determined to be patentable as amended.

Claims 15 and 22, dependent on an amended claim, are determined to be patentable.

2. [The combination bag and liner of claim 1] *In combination with a flexible and collapsible bulk bag having a side wall, ends and an opening adjacent one end to the exterior of the bag through which contents are discharged, and a flexible and collapsible liner received in said bag generally complimentary thereto and having a side wall, ends and an opening adjacent one end through which the contents are discharged; the improvement comprising, at least two connectors between said liner and bag and each connecting said liner to said bag,* wherein said connectors permanently connect said liner to said bag, *said connectors projecting from the exterior of the liner and directly stitched to said bag, said connectors being unitary, said connectors being spaced apart and each located adjacent a side wall portion of said bag and adjacent the one end of said bag and liner having the discharge openings therethrough, and all of said connectors being constructed, arranged, located and connected to said liner such that said liner is not withdrawn from said bag and can collapse upon itself during discharge of the contents thereof independently of and without being substantially restricted by said bag from collapsing, whereby the contents of said bag and liner are discharged through said openings without the liner being withdrawn from said bag by such discharge.*

5. [The combination of bag and liner of claim 4] *In combination with a flexible and collapsible bulk bag having a sidewall, ends and an opening adjacent one end to the exterior of the bag through which contents are discharged, and a flexible and collapsible liner received in said bag generally complimentary thereto and having a sidewall, ends and an opening adjacent one end through which the contents are discharged; the improvement comprising, at least two connectors between said liner and bag and each connecting said liner to said bag, said connectors being spaced apart and each located adjacent a sidewall portion of said bag and adjacent the one end of said bag and liner having the discharge openings therethrough, each of said connectors having a first tab connected to said bag and having a hole therethrough, a second tab connected to said liner and having a hole therethrough, and a fastener received in both of said holes of said first and second tabs and constructed and arranged to releasably connect the tabs together so that the liner can be disconnected and removed from the bag* wherein said fastener comprises a removable ring, *and all of said connectors being constructed, arranged, located and connected to said liner such that said liner is not withdrawn from said bag and can collapse upon itself during discharge of the contents thereof independently of and without being substantially restricted by said bag from collapsing, whereby the contents of said bag and liner are discharged through said openings without the liner being withdrawn from said bag by such discharge.*

6. [The combination bag and liner of claim 4] *In combination with a flexible and collapsible bulk bag having a sidewall, ends and an opening adjacent one end to the exterior of the bag through which contents are discharged, and a flexible and collapsible liner received in said bag generally complimentary thereto and having a sidewall, ends and an opening adjacent one end through which the contents are discharged; the improvement comprising, at least two connectors between said liner and bag and each connecting said liner to said bag, said connectors being spaced apart and each located adjacent a sidewall portion of said bag and adjacent the one end of said bag and liner having the discharge openings therethrough, each of said connectors having a first tab connected to said bag and having a hole therethrough, a second tab connected to said liner and having a hole therethrough,* which also comprises a grommet disposed in said hole of each of said first and second tabs *and a fastener received in both of said holes of said first and second tabs and constructed and arranged to releasably connect the tabs together so that the liner can be disconnected and removed from the bag, and all of said connectors being constructed, arranged, located and connected to said liner such that said liner is not withdrawn from said bag and can collapse upon itself during discharge of the contents thereof independently of and without being substantially restricted by said bag from collapsing, whereby the contents of said bag and liner are discharged through said openings without the liner being withdrawn from said bag by such discharge.*

7. [The combination bag and liner of claim 4] *In combination with a flexible and collapsible bulk bag having a sidewall, ends and an opening adjacent one end to the exterior of the bag through which contents are discharged, and a flexible and collapsible liner received in said bag generally complimentary thereto and having a sidewall, ends and an opening adjacent one end through which the contents are discharged; the improvement comprising, at least two connectors between said liner and bag and each connecting said liner to said bag, said connectors being spaced apart and each located adjacent a sidewall portion of said bag and adjacent the one end of said bag and liner having the discharge openings therethrough, each of said connectors having a first tab connected to said bag and having a hole therethrough, a second tab connected to said liner and having a hole therethrough, and a fastener received in both of said holes of said first and second tabs and constructed and arranged to releasably connect the tabs together so that the liner can be disconnected and removed from the bag, and all of said connectors being constructed, arranged, located and connected to said liner such that said liner is not withdrawn from said bag and can collapse upon itself during discharge of the contents thereof independently of and without being substantially restricted by said bag from collapsing, whereby the contents of said bag and liner*

*are discharged through said openings without the liner being withdrawn from said bag by such discharge,* wherein each of said second tabs is a loop of adhesive tape with its end portions adhered to said liner.

8. [The combination bag and liner of claim 4] *In combination with a flexible and collapsible bulk bag having a sidewall, ends and an opening adjacent one end to the exterior of the bag through which contents are discharged, and a flexible and collapsible liner received in said bag generally complimentary thereto and having a sidewall, ends and an opening adjacent one end through which the contents are discharged; the improvement comprising, at least two connectors between said liner and bag and each connecting said liner to said bag, said connectors being spaced apart and each located adjacent a sidewall portion of said bag and adjacent the one end of said bag and liner having the discharge openings therethrough, each of said connectors having a first tab connected to said bag and having a hole therethrough , a second tab connected to said liner and having a hole therethrough, and a fastener received in both of said holes of said first and second tabs and constructed and arranged to releasably connect the tabs together so that the liner can be disconnected and removed from the bag, and all of said connectors being constructed, arranged, located and connected to said liner such that said liner is not withdrawn from said bag and can collapse upon itself during discharge of the contents thereof independently of and without being substantially restricted by said bag from collapsing, whereby the contents of said bag and liner are discharged through said openings without the liner being withdrawn from said bag by such discharge,* wherein each of said second tabs is a loop of fiber reinforced adhesive tape with its end portions adhered to said liner.

9. [The combination bag and liner of claim 4] *In combination with a flexible and collapsible bulk bag having a sidewall, ends and an opening adjacent one end to the exterior of the bag through which contents are discharged, and a flexible and collapsible liner received in said bag generally complimentary thereto and having a sidewall, ends and an opening adjacent one end through which the contents are discharged; the improvement comprising, at least two connectors between said liner and bag and each connecting said liner to said bag, said connectors being spaced apart and each located adjacent a sidewall portion of said bag and adjacent the one end of said bag and liner having the discharge openings therethrough, each of said connectors having a first tab connected to said bag and having a hole therethrough, a second tab connected to said liner and having a hole therethrough, and a fastener received in both of said holes of said first and second tabs and constructed and arranged to releasably connect the tabs together so that the liner can be disconnected and removed from the bag, and all of said connectors being constructed, arranged, located and connected to said liner such that said liner is not withdrawn from said bag and can collapse upon itself during discharge of the contents thereof independently of and without being substantially restricted by said bag from collapsing, whereby the contents of said bag and liner are discharged through said openings without the liner being withdrawn from said bag by such discharge,* wherein said liner is made of plastic film and each of said second tabs comprises two strips of overlapped plastic film heat sealed together and each a homogenously integral portion of a panel of plastic film of said liner.

13. The combination bag and liner of claim [1] *2* wherein said liner is made of plastic film and each of said connectors comprises two strips of overlapped plastic film heat sealed together and each a homogeneously integral portion of a panel of plastic film of said liner, and said strips are permanently secured to said bag.

14. The combination bag and liner of claim [1] *2* which also comprises at least one connector located adjacent the other end of said bag and liner and connecting said liner to said bag.

16. The combination bag and liner of claim [1] *2* which also comprises at least two spaced apart connectors located adjacent the other end of said bag and liner, and each also located adjacent the side of said bag and liner and connecting said liner to said bag.

17. The combination bag and liner of claim [1] *2* wherein at least four of said connectors are located adjacent said one end of said bag and liner.

18. The combination bag and liner of claim [1] *2* which also comprises a discharge spout of said bag at least in part defining said discharge opening of said bag, a discharge spout of said liner defining at least in part said discharge opening of said liner and being extendable into said discharge spout of said bag.

19. In combination with a flexible and collapsible bulk bag having a sidewall, ends and an opening adjacent one end to the exterior of the bag through which contents are discharged, and a flexible and collapsible liner received in said bag generally complimentary thereto and having a sidewall, ends and an opening adjacent one end through which the contents are discharged, the improvement comprising, at least two connectors between said liner and bag and each connecting said liner to said bag, said connectors being spaced apart and each located adjacent a sidewall portion of said bag and adjacent the one end of said bag and liner having the discharge openings therethrough, a discharge spout of said bag at least in part defining said discharge opening of said bag, a discharge spout of said liner defining at least in part said discharge opening of said liner and being extendable into said discharge spout of said bag, a connector located generally upstream of and adjacent to said discharge liner spout and permanently connecting said bag and liner together upstream of said spout of said discharge liner, and all of said connectors beings constructed, arranged, located and connected to said liner such that said liner is not withdrawn from said bag and can collapse upon itself during discharge of the contents thereof independently of and without being substantially restricted by said bag from collapsing, whereby the contents of said bag and liner are discharged through said openings without the liner being withdrawn from said bag by such discharge, *and a wear sleeve of a flexible material received within and lapping at least a portion of said spouts of both said liner and bag, and a connector permanently connecting said sleeve to said bag upstream of the outlet end of said spout of said bag, wherein said last mentioned connector also connects said liner to said bag upstream of, adjacent to and generally around the periphery of said discharge spout of said liner.*

23. The combination bag and liner of claim [21] *19* wherein said liner has a pair of generally rectangular side panels and a pair of interconnecting gusseted panels complimentary to their corresponding bag panels and is constructed and arranged when expanded to have generally cubical configuration and when empty can be folded into a generally flat configuration.

26. [The combination bag and liner of claim 24] *In combination with a flexible and collapsible bulk bag having a side wall, ends and a spout adjacent each end which can be opened to the exterior of the bag and through which its contents can be discharged, and a flexible and collapsible liner received in said bag generally complimentary thereto and having a side wall, ends and a spout in each end through which the contents can be discharged; the improvement comprising, at least one connector between said liner and bag adjacent each end and each connecting said liner to said bag, each connector being located adjacent the periphery of an associated spout and its associated end and permanently connecting together said bag and liner, and all of said connectors being constructed, arranged, located and connected to said liner such that said liner is not withdrawn from said bag and can collapse upon itself during discharge of the contents thereof independently of and without being substantially restricted by said bag from collapsing, whereby the contents of said bag and liner are discharged through said openings without the liner being withdrawn from said bag by such discharge,* wherein each of said connectors comprises stitching extending generally around substantially the entire periphery of its associated spout.

* * * * *